United States Patent [19]

Kolbeck et al.

[11] 4,104,554

[45] Aug. 1, 1978

[54] ELECTRON BEAM PRODUCING ARRANGEMENT FOR A CATHODE RAY TUBE

[75] Inventors: Rainer Kolbeck; Heinz Kuckenburg, both of Ulm, Donau; Klaus Schaffernicht, Herrlingen, all of Germany

[73] Assignee: Licentia Patent-Verwaltungs-G.m.b.H., Frankfurt am Main, Fed. Rep. of Germany

[21] Appl. No.: 768,707

[22] Filed: Feb. 15, 1977

[30] Foreign Application Priority Data

Feb. 20, 1976 [DE] Fed. Rep. of Germany ..... 2606896
Feb. 20, 1976 [DE] Fed. Rep. of Germany ... 7605093[U]

[51] Int. Cl.[2] ..... H01J 29/02; H01J 29/46

[52] U.S. Cl. ..... 313/447; 313/458

[58] Field of Search ..... 313/447, 446, 451, 456, 313/458, 417, 441, 271 (U.S. only)

[56] References Cited

U.S. PATENT DOCUMENTS 2,227,087 12/1940 Hinsch ..... 313/451
2,732,512 1/1956 Briggs ..... 313/451 X

FOREIGN PATENT DOCUMENTS 656,459 8/1951 United Kingdom ..... 313/446

*Primary Examiner*—Robert Segal
*Attorney, Agent, or Firm*—Spencer & Kaye

[57] ABSTRACT

An electron beam producing arrangement for a cathode ray tube comprises a vessel shaped control electrode with a bore therein for passage of the electron beam and a hat shaped metal foil element with its crown in the bore and apertured for the passage of the electron beam and fixed to the edge of the bore by its brim.

11 Claims, 1 Drawing Figure

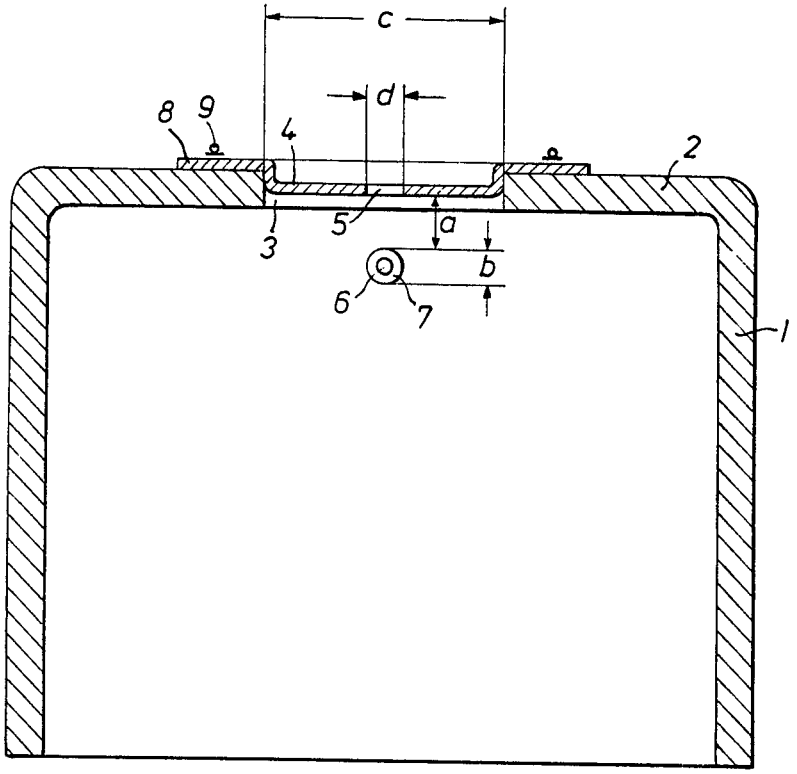
c
d
8
9
4
2
3
5
a
b
6
7
1

ELECTRON BEAM PRODUCING ARRANGEMENT FOR A CATHODE RAY TUBE

BACKGROUND OF THE INVENTION

The present invention relates to an electron beam producing arrangement for a cathode ray tube having a target electrode constructed like a fluorescent screen, comprising a vessel-shaped metallic control electrode with a wall thickness which is reduced in the region of an opening for the passage of the beam and comprising a cathode arranged inside the control electrode and in front of the opening for the passage of the beam.

Beam generators for cathode ray tubes, which comprise a cathode wire running perpendicular to the tube axis, are already known from German Auslegeschrift No. 12 79 215, the cathode wire being arranged inside a vessel-shaped control electrode below the opening in the control electrode for passage of the beam. With very small heat output, sufficiently large beam currents may be produced for the cathode with this type of beam generator, if the opening for passage of the beam and the spacing therein are chosen to be sufficiently small. For reasons of stability, the thickness of the material of the control grid must however have a certain thickness whereby the necessary magnitudes are influenced relatively unfavourably. In an earlier German Patent Applicaton No. 25 38 436, it has already been suggested to introduce a fairly large opening into the control electrode in a system for producing an electron beam and to cover this opening with a thin foil which carries the opening for passage of the beam.

SUMMARY OF THE INVENTION

It is an object of the invention to provide a new type of generator of an electron beam such as of the type stated at the outset, which is improved with respect to its construction and manufacture.

According to the invention, there is provided an electron beam producing arrangement for a cathode ray tube comprising a vessel-shaped control electrode defining a bore surrounding an area for passage of the electron beam and a hat-shaped element of metal foil arranged with its crown in said bore of said control electrode, fixed to the edge of said bore by its brim and defining an aperture for the passage of the electron beam.

Further according to the invention, there is provided an electron beam producing arrangement for a cathode ray tube comprising a target electrode constructed like a fluorescent screen, said target electrode consisting of a vessel-shaped metallic control electrode having a wall thickness which is reduced in the region of the opening for passage of the beam and comprising a cathode arranged inside the control electrode and in front of the opening for passage of the beam, characterized in that said opening for passage of the beam is arranged in a hat-shaped drawn dish made of metal foil; that the dish is placed in a bore in the end wall of said control electrode with its substantially cylindrical part and that the dish is fixed at its edge to said end wall of said control electrode.

BRIEF DESCRIPTION OF THE DRAWINGS

The invention will now be described in greater detail, by way of example, with reference to the drawing, the single FIGURE of which shows, in section, one embodiment of the invention.

DESCRIPTION OF THE PREFERRED EMBODIMENT

In a preferred embodiment of the invention, it is proposed that, in an electron beam generator as mentioned at the outset the opening for passage of the beam should be arranged in a hat-shaped dish made of metal foil; that the dish should be placed into a bore in the end wall of the control electrode with its substantially cylindrical part; and that the dish should be fixed at its edge to the end wall of the control electrode.

A substantial advantage of the invention is seen in its facility of manufacture. As it is a question of maintaining very small spacings, there is always the danger, particularly in matters of location and fixing, that as a result of the locating or fixing tools, permanent deformation may occur in the parts fixed inside one another, particularly if, as in the subject of application, materials having very thin wall thicknesses are used. Thus it has been proved to be particularly advantageous to provide the hat-shaped dish, placed into the bore of the control electrode, with a relatively wide edge whereby it is made possible in a simple manner to apply spot welding technology for the purpose of fixing without deformation occurring in the critical region of the opening in the basin for passage of the beam.

Referring now to the drawing, there is shown a generator for an electron beam in cross-section having a vessel-shaped control electrode 1, the end wall 2 of which has an enlarged bore 3. The control electrode is preferably rotationally symmetrical to the axis of the electron beam tube. In accordance with the invention a dish-shaped metal foil 4 is now placed into the bore 3 of the control electrode, the edge 8 of said metal foil extending substantially beyond the bore 3. Fixing of this foil dish 4 is preferably undertaken by means of heavy spot welding 9, which is arranged at the edge 8 of the dish. The approximately cylindrical part of the dish is chosen in its outer diameter such that if fits as exactly as possible into the bore 3 in the end wall 2 of the control electrode 1, whereby it is possible to avoid additional centring problems. The bore 3 may be manufactured by means of drilling, stamping or the like.

In accordance with a further preferred feature, the dish is placed in the bore so that the edge 8 abuts the outer surface of the end wall 2 of the control electrode 1, as shown in the FIGURE.

It may be particularly advantageous to choose the depth of the basin so that the surface of the part of the basin 4 projecting into the bore 3 with the opening 5 for passage of the beam forms a plane with the inner surface of the end wall 2 of the control electrode 1.

In accordance with a further preferred feature, the described construction of the control electrode may be used in conjunction with a cathode, which comprises a straight line cathode wire 6, which is arranged running parallel to the inner surface of the end wall 2 and lying below the opening 5 for passage of the beam. This type of arrangement is shown in the drawing. There the cathode wire is designated 6 and an emission layer on the cathode wire is designated 7, this emission layer being arranged at least in that region which is located below the opening 5 for the passage of the beam. A beam generator constructed in this manner facilitates maintaining a very small spacing with relatively little difficult manufacturing technology.

In a practical example, the diameter *c* of the bore 3 in the end wall 2 of the control electrode 1 was approximately 4 mm. The thickness of the material of the end wall 2 was approximately 0.3 mm. The metal foil from which the dish 4 is drawn, had a thickness of approximately 0.05 mm and the diameter *d* of the opening 5 for the passage of the beam was approximately 0.3 mm. The heated wire 6 of the cathode consisted of a tensioned wire having a diameter of approximately 0.03 mm. The diameter *b* of the cathode wire was approximately 0.09 mm in the region coated with emission material 7 and the spacing *a* from the upper surface of the emission layer 7 to the opposite upper surface of the dish was approximately 0.25 mm.

This type of beam generator could be driven at a heating power of approximately 35 mV. The blocking voltage of the control electrode was at minus 20 to minus 25 volts. In order to achieve different brilliances in the electron beam, the operating voltage at the control electrode 1 could be varied approximately between the blocking voltage of minus 20 to minus 25 volts and the maximum scanning voltage up to approximately minus 5 volts in relation to the cathode voltage.

It will be understood that the above description of the present invention is susceptible to various modification changes and adaptations.

What is claimed is:

1. An electron beam producing arrangement for a cathode ray tube comprising a target electrode constructed like a fluorescent screen, said target electrode consisting of a vessel-shaped metallic control electrode having a wall thickness which is reduced in the region of the opening for passage of the beam and comprising a cathode arranged inside the control electrode and in front of the opening for passage of the beam, characterized in that said opening for passage of the beam is arranged in a hat-shaped drawn dish made of metal foil; that said dish is placed in a bore in the end wall of said control electrode with its substantially cylindrical part; that said dish is fixed at its edge to the outer surface of said end wall of said control electrode; and that said cathode has an electrically heatable cathode wire tensioned by at least one spring, with said wire being arranged at a spacing of 0.15 to 0.4 mm from the upper surface of said dish, below said opening for the passage of the beam and running substantially parallel to said end wall of said control electrode.

2. An arrangement as defined in claim 1, wherein said bore in said end wall has a diameter larger than 1.0 mm.

3. An arrangement as defined in claim 1, wherein said bore in said end wall has a diameter from 1.5 mm to 5 mm.

4. An arrangement as defined in claim 1, wherein said bore in said end wall has a diameter from 2.5 mm to 4.5 mm.

5. An arrangement as defined in claim 1, wherein the thickness of said foil of said dish is from 0.03 mm to 0.08 mm.

6. An arrangement as defined in claim 1, wherein the thickness of said foil of said dish is from 0.04 to 0.06 mm.

7. An arrangement as defined in claim 1, wherein the diameter of said opening for passage of the beam is from 0.2 to 0.4 mm.

8. An arrangement as defined in claim 1, wherein said edge is fixed by means of several welding points to said end wall of said control electrode.

9. An arrangement as defined in claim 1, wherein said wire is arranged at a spacing of 0.2 to 0.3 mm from the upper surface of said dish.

10. An arrangement as defined in claim 1, and comprising an emission layer on said heated wire at least in its region lying below the opening for passage of the beam.

11. An arrangement as defined in claim 1, wherein the diameter of said cathode wire is smaller than the radius of said opening for the passage of the beam.

* * * * *